US007644803B2

(12) United States Patent
Hashizume

(10) Patent No.: US 7,644,803 B2
(45) Date of Patent: Jan. 12, 2010

(54) SILENCING DEVICE

(75) Inventor: Masahiro Hashizume, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 395 days.

(21) Appl. No.: 11/605,298

(22) Filed: Nov. 29, 2006

(65) Prior Publication Data

US 2007/0125593 A1 Jun. 7, 2007

(30) Foreign Application Priority Data

Dec. 6, 2005 (JP) ..... 2005-352488

(51) Int. Cl.
*F01N 1/06* (2006.01)

(52) U.S. Cl. ..... 181/225; 181/206; 181/224; 415/211.1; 415/211.2

(58) Field of Classification Search ..... 181/206, 181/224, 225; 415/211.1, 211.2
See application file for complete search history.

(56) References Cited

U.S. PATENT DOCUMENTS 1,938,800 A * 12/1933 Bourne ..... 454/206
1,955,479 A * 4/1934 Weinberger ..... 454/338
3,059,564 A * 10/1962 Curran et al. ..... 454/262
5,326,317 A * 7/1994 Ishizu et al. ..... 454/354
5,332,872 A * 7/1994 Ewanek ..... 181/224
5,470,363 A * 11/1995 Leader et al. ..... 96/385
5,532,439 A * 7/1996 Minkin ..... 181/224
5,625,172 A * 4/1997 Blichmann et al. ..... 181/204
6,104,608 A * 8/2000 Casinelli et al. ..... 361/692
6,145,616 A * 11/2000 Ewanek ..... 181/224
6,217,281 B1 * 4/2001 Jeng et al. ..... 415/119
6,459,578 B1 * 10/2002 Wagner ..... 361/694
6,892,851 B2 * 5/2005 Lee ..... 181/224
2004/0134712 A1 * 7/2004 Lee ..... 181/224
2004/0200664 A1 * 10/2004 Monson et al. ..... 181/224

FOREIGN PATENT DOCUMENTS

JP 60187798 A * 9/1985
JP 05-73072 A 3/1993

* cited by examiner

*Primary Examiner*—Jeffrey Donels
*Assistant Examiner*—Jeremy Luks
(74) *Attorney, Agent, or Firm*—Shinjyu Global IP

(57) ABSTRACT

A silencing device disposed to the outside of a fan 2 that discharges air from the interior of a device 1 to the outside. The silencing device includes a reflection plate 6 provided substantially normal to the rotation axis 2*a* of the fan 2, and a right-angled parallelepiped shaped duct 4 that guides air from the fan 2 to the outside of the device 1. The reflection plate 6 is disposed at the other end of the duct 4, an air discharge slit 7 is formed in at least one of the four sides of the reflection plate 6, and the distance from the fan 2 to the reflection plate 6 satisfies the relationship $L=(\lambda/2)\times n$. n is a natural number, and $\lambda$ is the wavelength of the maximum component from among the wavelength components that constitutes the sound generated by the fan 2.

14 Claims, 13 Drawing Sheets

SILENCING DEVICE

CROSS-REFERENCE TO RELATED APPLICATIONS

This application claims priority to Japanese Patent Application No. 2005-352488 filed on Dec. 6, 2005. The entire disclosure of Japanese Patent Application No. 2005-352488 is hereby incorporated herein by reference.

BACKGROUND OF THE INVENTION

1. Field of the Invention

The present invention generally relates to a silencing device. More specifically, the present invention relates to a silencing device that reduces the noise of a fan provided in copying machines and the like.

2. Background Information

Fans are provided in electronic equipment such as copiers, televisions, and personal computers, to discharge the air within the device to the outside of the device to reduce the temperature within the device. Referring to FIG. 13, this type of device includes louvers 101 or the like to change the direction of the wind so that the wind from the fan 100 is not directly discharged outside the device, as shown in FIG. 13.

In this type of device sound is generated by the fan 100 cutting through the air, and the sound leaks are transmitted by device. Depending on the user, this cutting noise of the fan 100 can be perceived as uncomfortable.

A device to reduce this type of noise from a fan is disclosed in for example Japanese Patent Application Laid-open No. H5-73072.

In the device disclosed in this publication, a sound with phase inversion is generated in a separately provided speaker, to reduce the sound of a motor-driven fan for dissipating heat installed in part of a television image receiver. However, as disclosed in the publication, the control method for the active controls to generate the sound with phase inversion is complex. Also, it is necessary to provide a separate speaker and so on, so the number of components increases, which increases the cost.

In view of the above, it will be apparent to those skilled in the art from this disclosure that there exists a need for an improved silencing device. This invention addresses this need in the art as well as other needs, which will become apparent to those skilled in the art from this disclosure.

SUMMARY OF THE INVENTION

It is an object of the present invention to provide a silencing device that can more simply and more cheaply reduce noise.

A silencing device in accordance with a first aspect of the present invention includes a reflection plate and a peripheral portion. The reflection plate is provided on the outside of a fan that discharges air from the interior of a device to the outside, and on the rotation axis of the fan and substantially normal or orthogonal with respect to the rotation axis. The reflection plate is a member that inverts the phase of specific frequencies of the sound generated by the fan.

A silencing device in accordance with a second aspect of the present invention is the device of the first aspect wherein the reflection plate is disposed at a position a distance L from the center of the thickness of the fan, where $L=(\lambda/2)\times n$. n is a natural number representing the number of compressions and rarefactions in a sound wave, and $\lambda$ is the wavelength of the specific frequencies of the sound generated by the fan.

A silencing device in accordance with a third aspect of the present invention is the device of the first aspect wherein the reflection plate is disposed further out from the device than the peripheral portion.

A silencing device in accordance with a fourth aspect of the present invention is the device of the third aspect further having a peripheral sloping portion provided between the reflection plate and the peripheral portion.

A silencing device in accordance with a fifth aspect of the present invention is the device of the first aspect further having a right-angled parallelepiped shaped duct that guides air from the fan to the outside of the device, wherein the fan is disposed at one end of the duct, the reflection plate is disposed at the other end of the duct, and an air discharge slit is formed in at least one edge of the four edges of the reflection plate.

A silencing device in accordance with a sixth aspect of the present invention is the device of the first aspect wherein an air discharge slit is not formed in the reflection plate.

A silencing device in accordance with a seventh aspect of the present invention is the device of the fifth aspect wherein the size of the reflection plate is substantially the same as or smaller than the aperture of the duct.

A silencing device in accordance with an eighth aspect of the present invention is the device of the fifth aspect wherein the reflection plate includes a projecting portion projecting in the direction of the fan on the surface in opposition to the fan.

A silencing device in accordance with a ninth aspect of the present invention is the device of the eighth aspect wherein the projecting portion includes a flat portion provided substantially in the center of the reflection plate, and a sloping portion formed from the flat portion to the sides of the reflection plate.

A silencing device in accordance with a tenth aspect of the present invention is the device of the eighth aspect wherein the projecting portion includes a vertex provided substantially in or in the center of the reflection plate being the shortest distance from the reflection plate to the fan, and a sloping portion formed from the vertex to the sides of the reflection plate.

A silencing device in accordance with a eleventh aspect of the present invention is the device of the first aspect wherein the reflection plate has a circular shape whose diameter is larger than the diameter of the fan.

A silencing device in accordance with a twelfth aspect of the present invention is the device of the first aspect wherein the distance between the reflection plate and the fan is adjustable.

According to the present invention, it is possible to provide a silencing device capable of reducing noise more easily and at lower cost.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

The following is an explanation of a silencing device according to a first preferred embodiment of the present invention with reference to the drawings.

Figure 1:
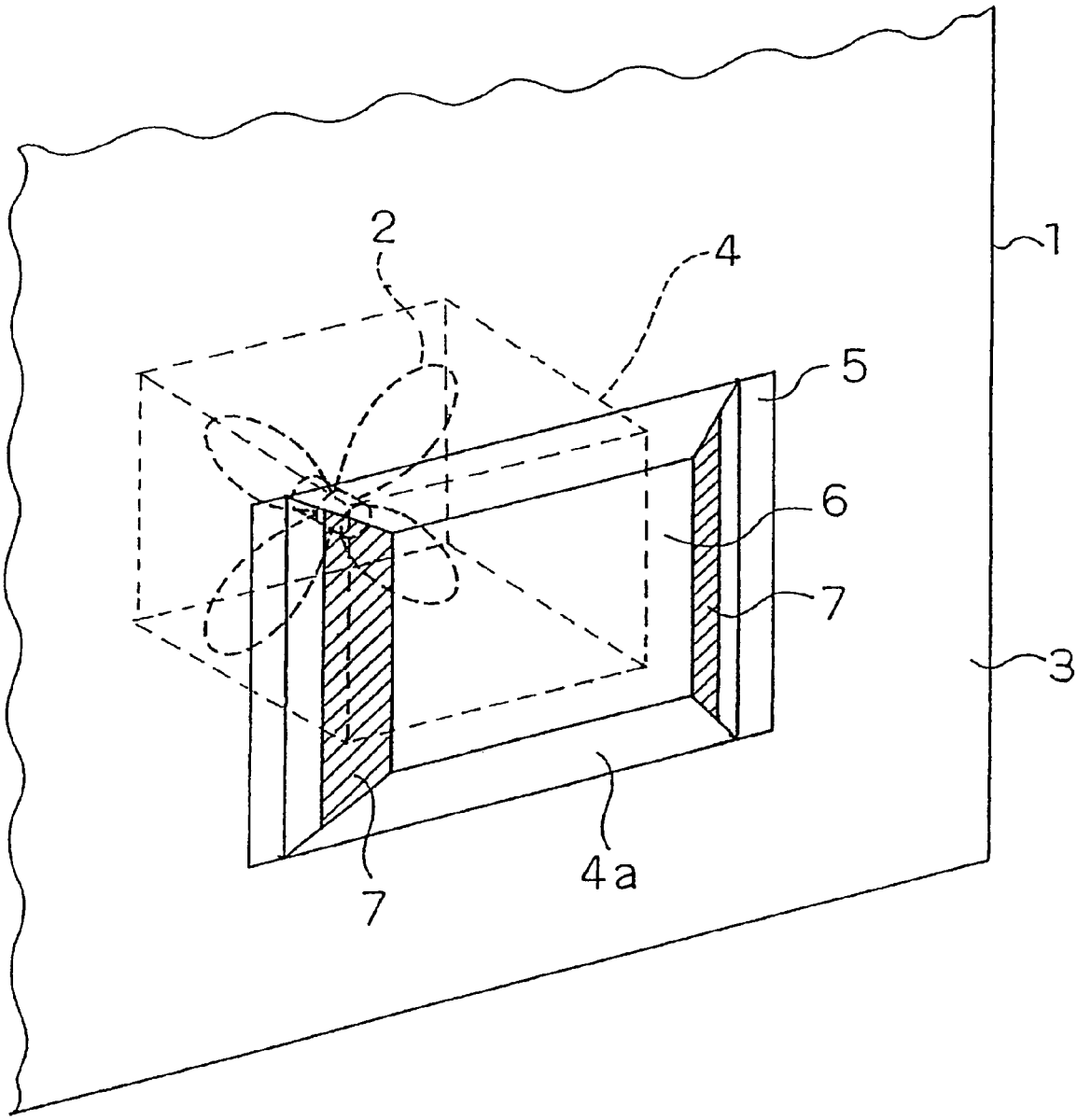
FIG. 1 is an external perspective view of the silencing device according to a first preferred embodiment of the present invention.
Figure 2:
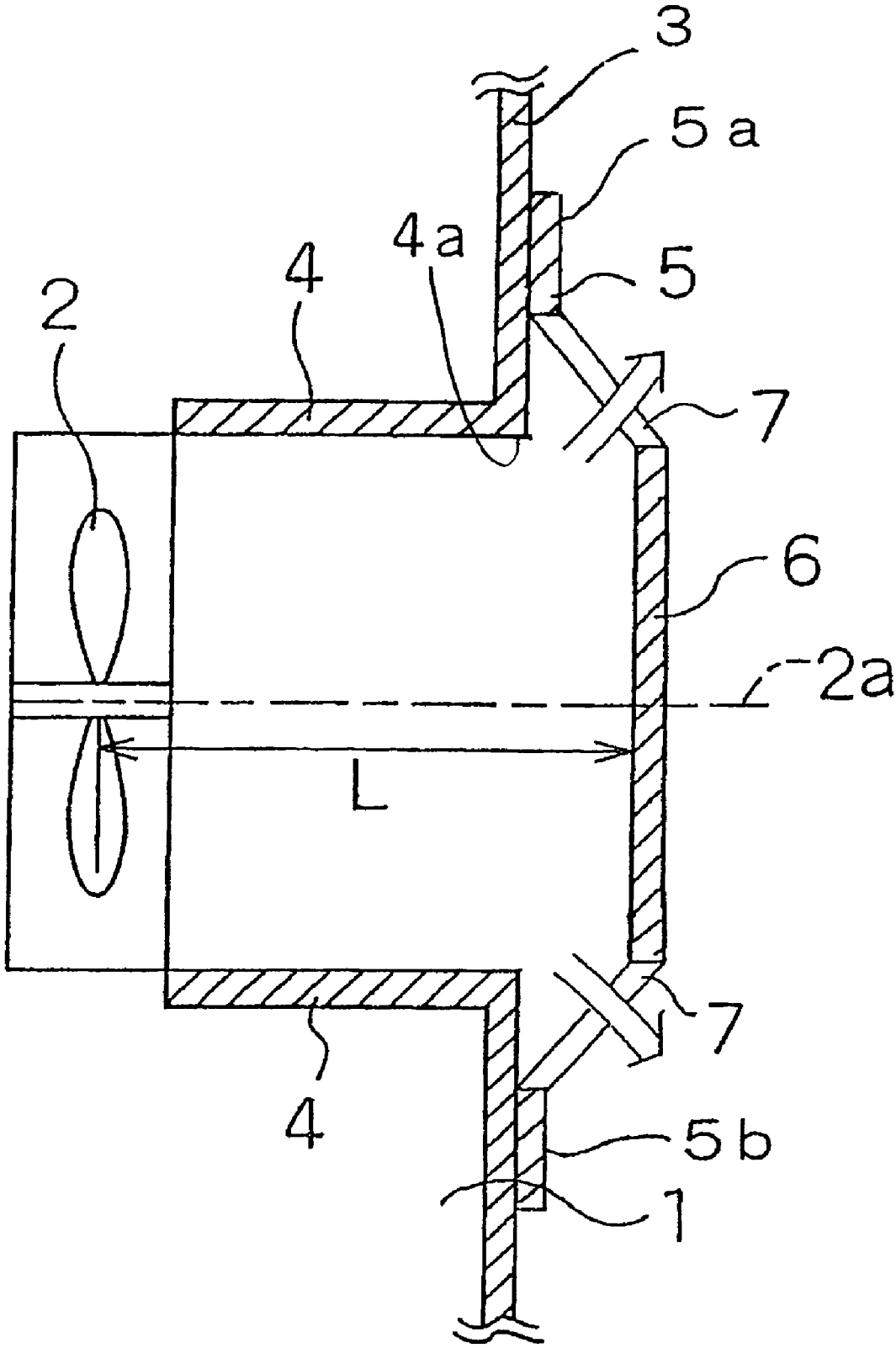
FIG. 2 is a cross-sectional plan view from above of the silencing device according to the first embodiment of the present invention.
Figure 3:
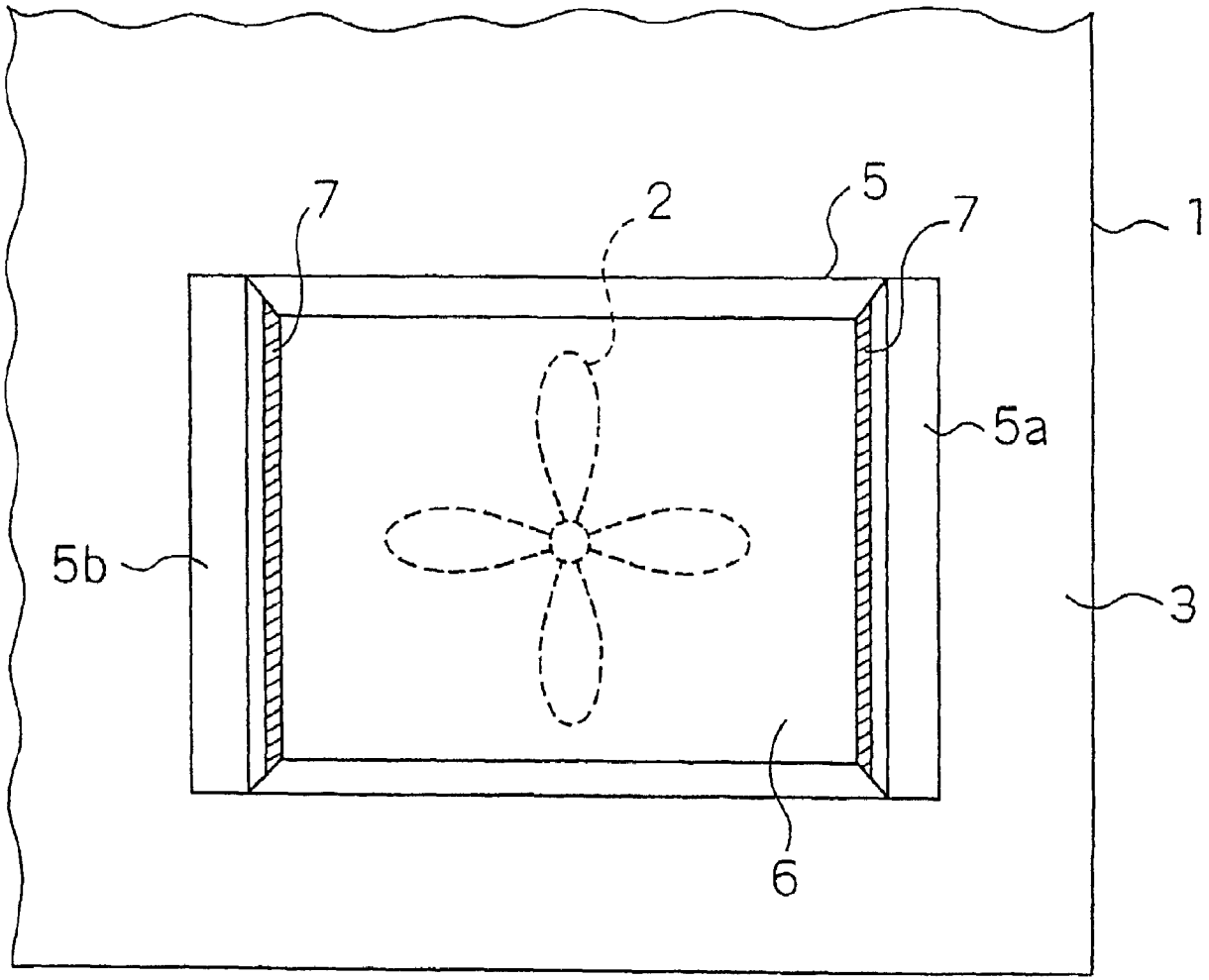
FIG. 3 is a front elevational view of the silencing device according to the first embodiment of the present invention.

FIG. 1 is a perspective external view of the silencing device according to the first preferred embodiment of the present invention. Also, FIG. 2 is a cross-sectional view from above of the silencing device according to the present embodiment. Further, FIG. 3 is a front elevational view of the silencing device according to the present embodiment. FIGS. 1 through 3 show the silencing device according to the present embodiment installed in a device having electronic equipment or similar inside.

As shown in FIGS. 1 through 3, a duct 4 that is an air discharge path is provided to cool the inside of a device (air discharge device) 1. The duct 4 is provided between a fan 2 provided to discharge the air within the device 1 to the outside of the device 1 and an external wall 3 of the device 1. The fan 2 is configured to expel air from a side opposite the duct 4 through the duct 4 to the outside of the device 1 with the silencing device being arranged in the path of the air being expelled.

Further, the silencing device according to the present embodiment includes a cover 5 disposed to cover an aperture 4*a* formed by the duct 4 in the external wall 3. The cover 5 includes a rectangular shaped reflection plate 6 disposed in the center thereof. The reflection plate 6 is disposed substantially or precisely normal to a rotation axis 2*a* of the fan 2. Further, the reflection plate 6 is disposed so that the center thereof is on the rotation axis 2*a*, and the area of the reflection plate 6 is substantially the same or the same as the area of the aperture 4*a*.

As shown in FIGS. 1 through 3, the cover 5 is attached and fixed to the external wall 3 by peripheral portions 5*a* and 5*b* on the left and right. Also, as shown in FIGS. 1 through 3, the reflection plate 6 is disposed further to the outside of the device 1 than the peripheral portions 5*a* and 5*b*. Sloping portions are formed from the sides of the reflection plate 6 to the sides of the cover 5 (including the peripheral portions 5*a* and 5*b*). Also, air discharge slits 7 are formed in the sloping portions on the left and right of the cover 5 to discharge the air from within the device 1. The air discharge slits 7 are formed in the vertical direction along the left side and the right side of the reflection plate 6. In other words, the reflection plate 6 is as or approximately as large as the aperture 4*a*, with the slits 7 being formed on the sides of the reflection plate 6 and not in the reflection plate 6. Thus, the reflection plate 6 is solid and non-porous.

The direction indicated by the arrows in FIG. 2 is the direction of discharge of the air.

Also, as shown in FIG. 2, the reflection plate 6 is disposed at a distance L from the center of the thickness of the fan 2 along the rotation axis 2*a*. The following is an explanation of the determination of the distance L.

The sound pressure levels for the frequencies of the sound generated by the fan 2 installed on the device 1 can be obtained by frequency analysis.

Here, as shown by equal loudness curves (ISO/R266), the sound pressure levels perceived by persons to have the same loudness varies depending on the frequency. This equal loudness curve is a graph showing sound pressure level on the vertical axis and frequency on the horizontal axis for the case where the "sound loudness level" P (phon) is defined as the sound pressure level of a 1 kHz traveling plane wave that is perceived to be the same loudness as a certain sound. From the equal loudness curve it can be seen that for a person to perceive aurally that the sound loudness level of sounds are the same, a higher sound pressure level is required for low frequencies (for example, 50 Hz) than for high frequencies (for example, 1000 Hz).

Therefore, it is possible to obtain the sound loudness level as a function of frequency by converting the sound pressure levels as a function of frequency generated by the fan 2 in accordance with the equal loudness curves. This sound loudness level is the loudness of the sound at each frequency based on a person's hearing.

If the wavelength of the frequency that gives the greatest sound loudness level after conversion is defined as $\lambda$, the distance L is set to satisfy Equation (1).

Equation (1) $L=(\lambda/2)\times n$ ($n=1, 2, 3, \ldots$), where n is a natural number representing the number of compressions and rarefactions in a sound wave.

The wavelength of the largest component in the present invention is, for example, in this embodiment the wavelength corresponding to the frequency with the largest sound loudness level after conversion. Further, the silencing device according to the present invention corresponds, for example, in the present embodiment to the cover 5 having the reflection plate 6, and the duct 4.

The following is an explanation of the reduction in the noise when the fan configured as described above is operated.

When the device 1 operates, the fan 2 is rotated to discharge the air within the device 1 to cool the electronic components and the like within the device 1.

Noise is generated as a result of the rotation of the fan.

Figure 4:
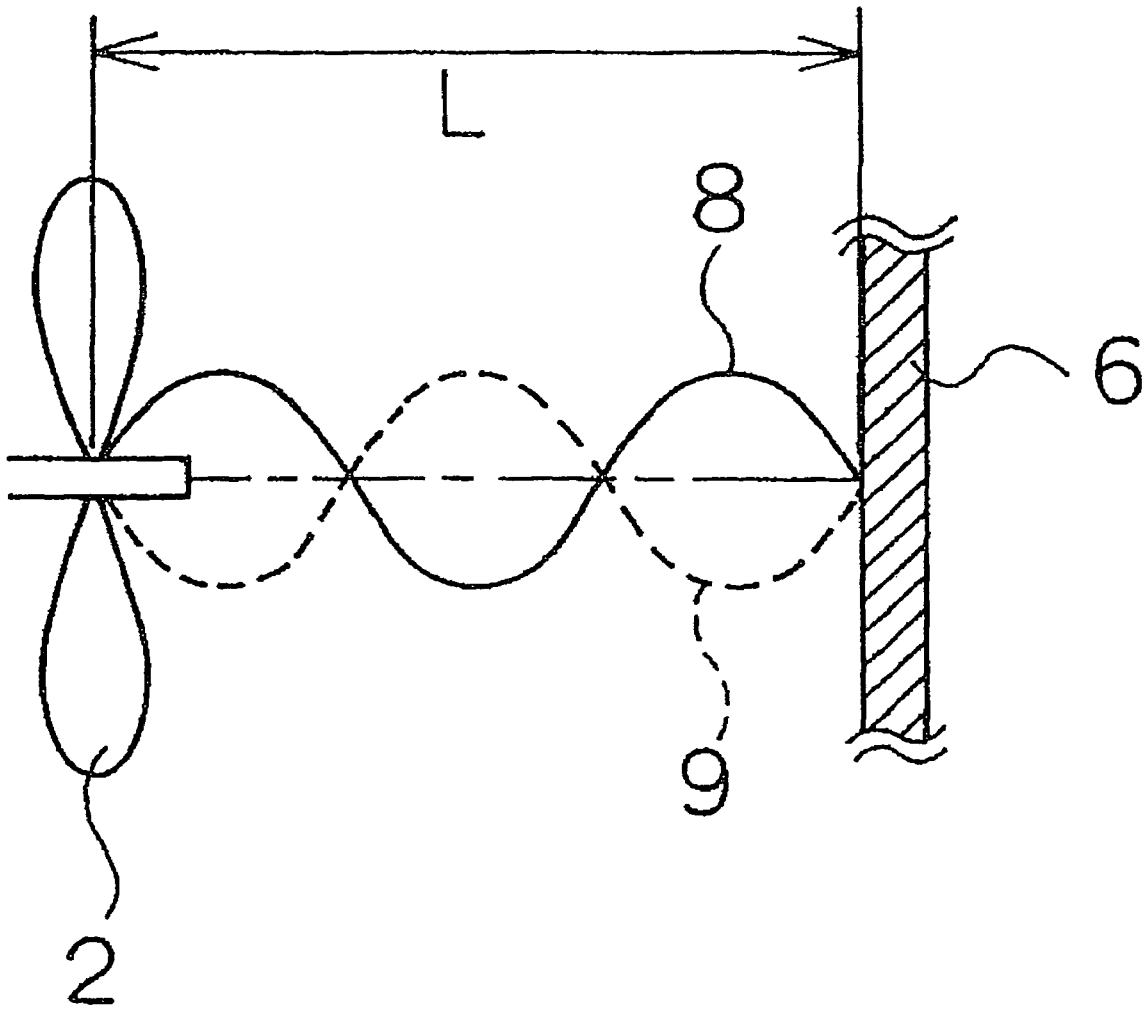
FIG. 4 is a view of diagram that is provided to explain the reduction of sound by the silencing device according to the present invention.

FIG. 4 shows the condition for the sound wave whose frequency has the greatest sound loudness level among the sounds generated by the fan 2, with the position of the reflection plate 6 adjusted with respect to the fan 2 so that n=3, i.e. 3 is the number of compressions and rarefactions in the sound wave between the fan 2 and reflection plate 6. In FIG. 4, a sound wave 8 at the frequency for which the sound loudness level is greatest among the sounds generated by the fan 2 is indicated by a solid line, and a sound wave 9 that is that sound wave reflected from the reflection plate 6 is indicated by a broken line.

As shown in FIG. 4, the sound wave 8 at the frequency for which the sound loudness level is greatest becomes the reflected wave 9 for which the phase is inverted by reflection at the reflection plate 6. Therefore, the sound wave at the frequency for which the sound loudness level is greatest among the sounds generated by the fan 2 and the reflected wave cancel each other. In other words, it is possible to eliminate the sound at the frequency for which the sound loudness level is greatest. FIG. 4 shows a case where n=3 is described, but n may be any natural number. The distance L may be any integer multiple of half the wavelength of the frequency for which the sound loudness level is greatest.

By limiting the sound reduction to the sounds having the greatest loudness levels as described above, it is possible to reduce the noise from the fan 2 with a simple configuration and at low cost. Further, the air discharged from the fan 2 is not directly discharged to the outside due to the presence of the reflection plate 6, but the air can be dispersed and discharged to the outside.

ALTERNATE EMBODIMENTS

Alternate embodiments will now be explained. In view of the similarity between the first and alternate embodiments, the parts of the alternate embodiments that are identical to the parts of the first embodiment will be given the same reference numerals as the parts of the first embodiment. Moreover, the descriptions of the parts of the alternate embodiments that are identical to the parts of the first embodiment may be omitted for the sake of brevity.

In the present embodiment the air discharge slits 7 are formed in the vertical direction along the left and right sides of the reflection plate 6. However, the air discharge slits 7 may be formed in the horizontal direction along the top and bottom sides of the reflection plate 6. Furthermore, the air discharge slits 7 may be formed along all four sides of the reflection plate 6. Moreover, the air discharge slit 7 may be formed in only one of the left or right sides of the reflection plate 6. In other words, the air discharge slits may be provided on at least one of the sides of the reflection plate 6.

Figure 5:
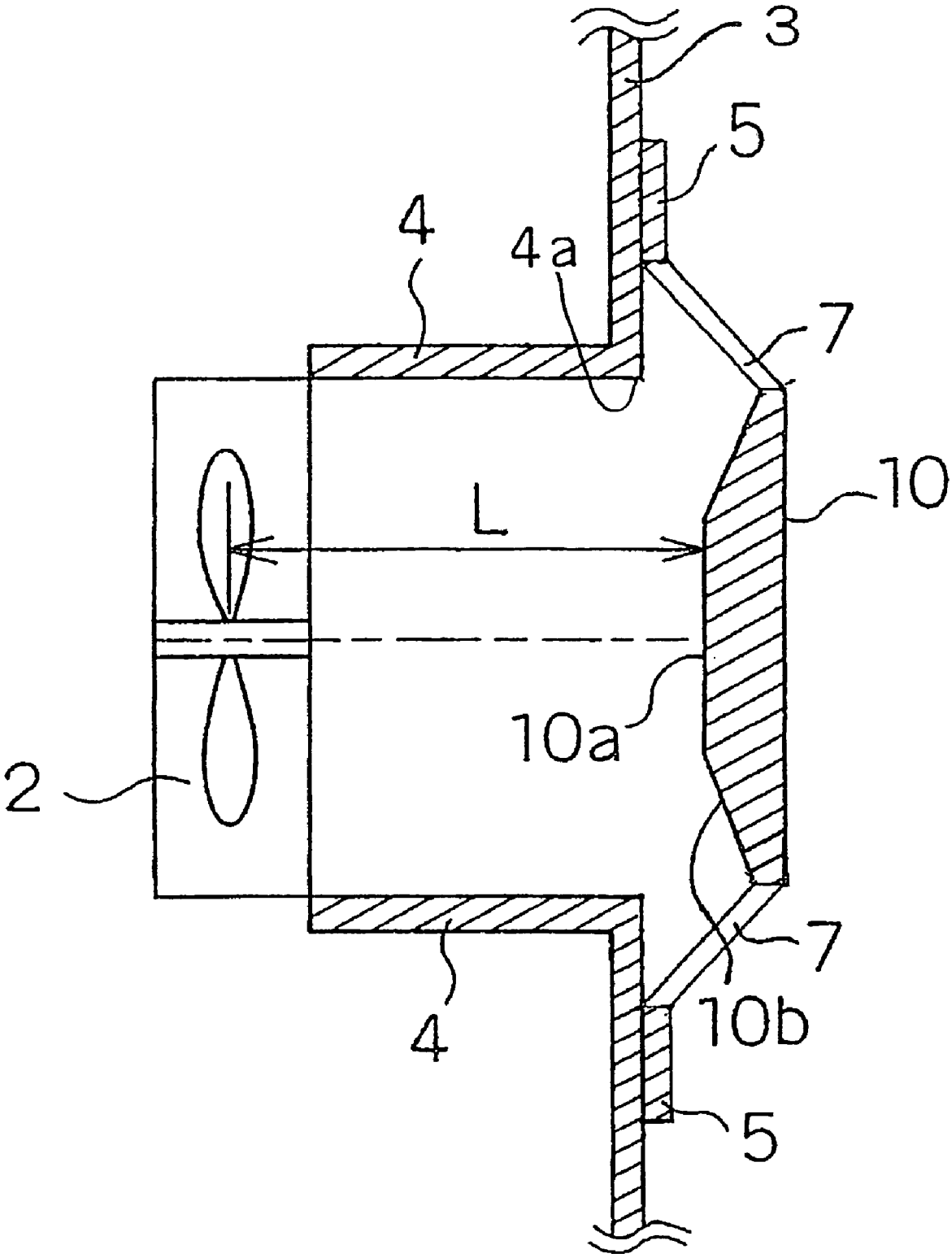
FIG. 5 is a cross-sectional plan view from above of the silencing device according to a second preferred embodiment of the present invention.

Further, in the present embodiment the reflection plate 6 has a plate or flat shape. However, the present invention is not limited to this, and the shapes such as those shown in FIGS. 5 and 6 may be used. FIG. 5 is a cross-sectional plan view of a silencing device in which a reflection plate 10 in accordance with a second preferred embodiment is provided instead of the reflection plate 6, viewed from above. Also, FIG. 6 is an external isometric view of the reflection plate 10.

The reflection plate 10 has a rectangular shaped flat portion 10*a* disposed substantially in or in the center of the surface on the fan 2 side. The flat portion 10*a* projects towards the fan 2, and a sloping portion 10*b* is formed from the sides of the flat portion 10*a* towards the sides of the reflection plate 10.

In this case, the reflection plate 10 is provided so that the distance from the fan 2 to the flat portion 10*a* is the distance L as stated above.

Figure 6:
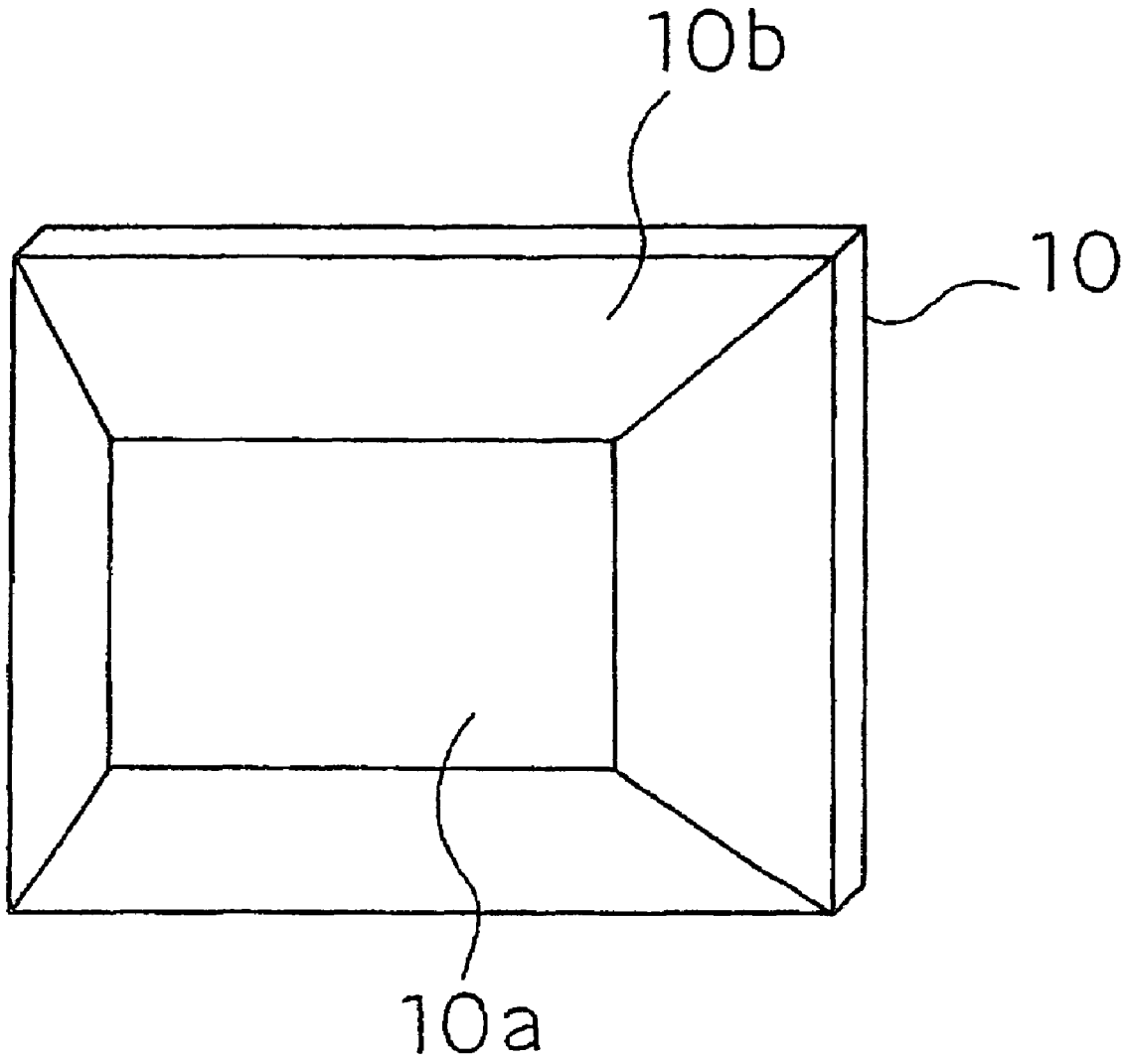
FIG. 6 is an external isometric view of the reflection plate of FIG. 5.

Also, as shown in FIGS. 5 and 6, by providing the sloping portion 10*b* around the flat portion 10*a*, when discharging the air within the device 1 from the fan 2, the discharged air can be efficiently guided to the air discharge slits 7.

Figure 7:
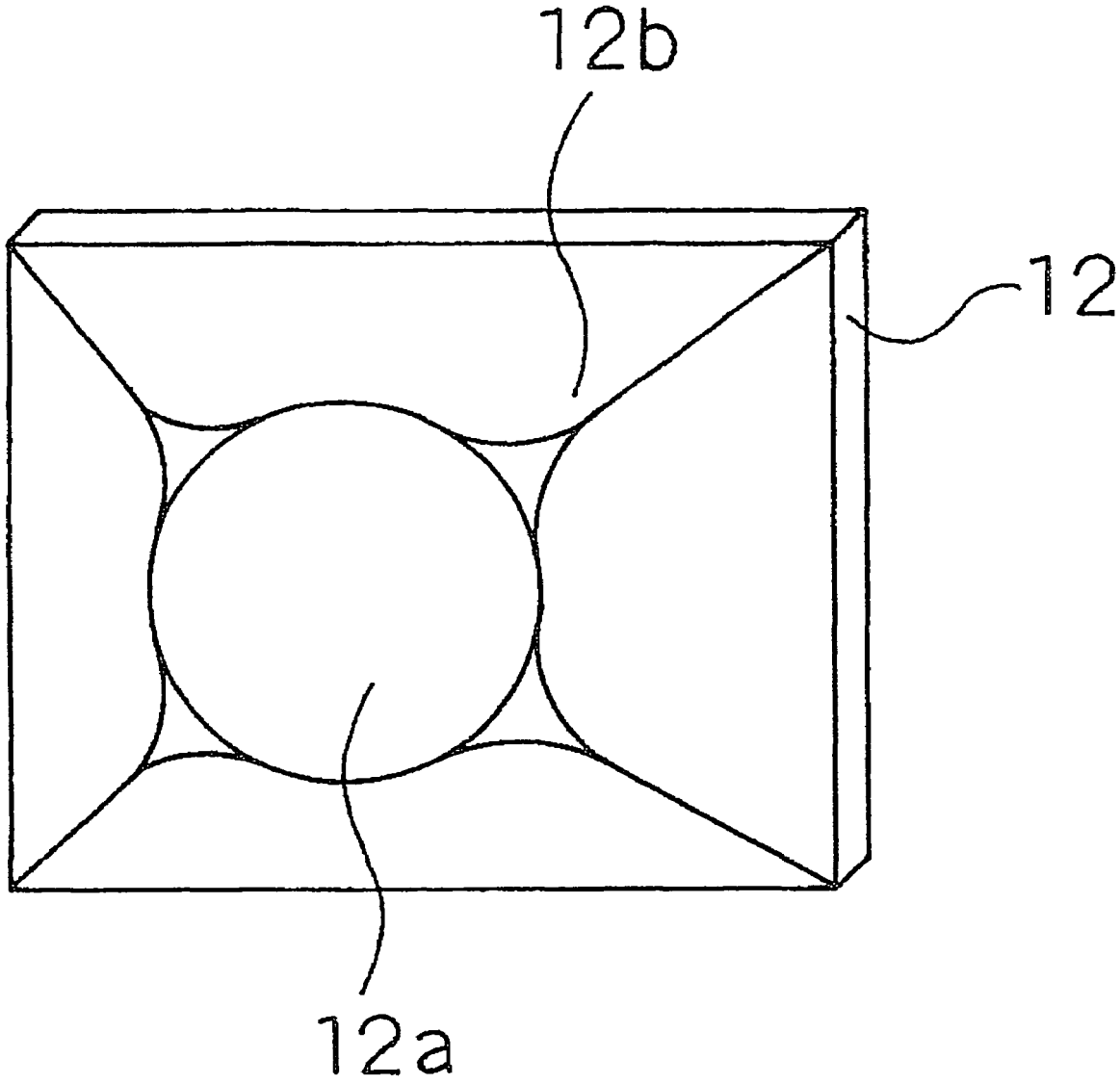
FIG. 7 is an external isometric view of a reflection plate according to a third preferred embodiment of the present invention.

Also, as shown in FIG. 7, the flat portion 10*a* does not have to be a rectangular shaped reflection plate, a reflection plate 12 in accordance with a third preferred embodiment having a circular shaped flat portion 12*a* may also be used. In this case also, a sloping portion 12*b* is formed from the flat portion 12*a* to the sides of the reflection plate 12, so the air discharged from the fan 2 can be efficiently guided to the air discharge slits 7.

Figure 8:
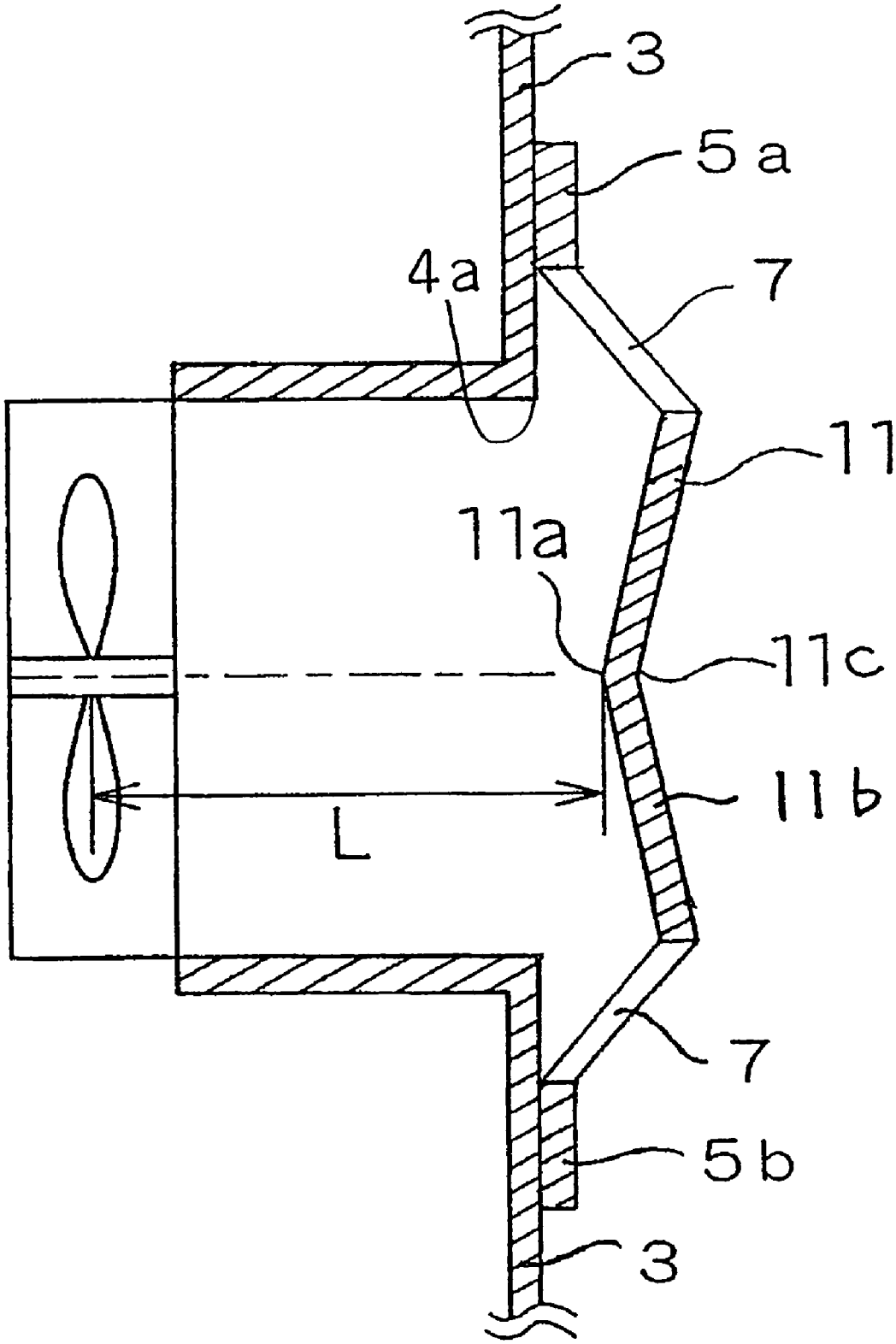
FIG. 8 is a cross-sectional plan view from above of a silencing device according to a fourth preferred embodiment of the present invention.
Figure 9:
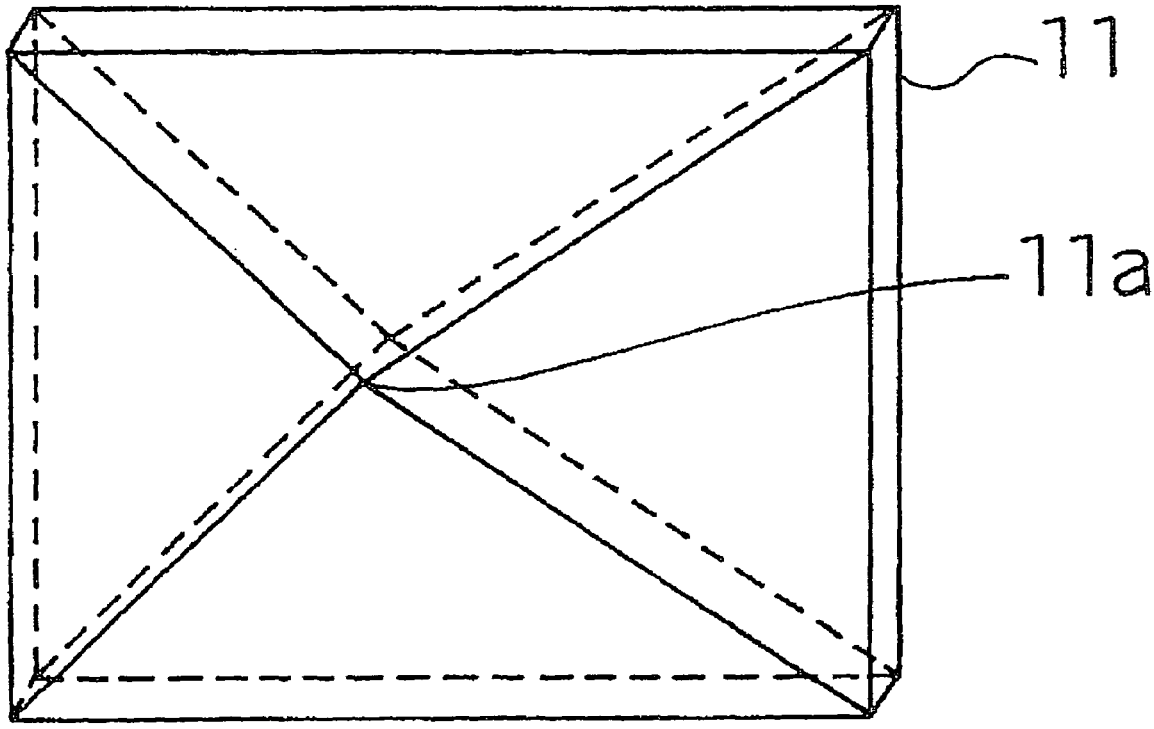
FIG. 9 is an external isometric view of a reflection plate of the silencing device of FIG. 8.

Also, a reflection plate 11 in accordance with a fourth preferred embodiment may have a shape as shown in FIGS. 8 and 9. FIG. 8 is a cross-sectional plan view shown from above of a silencing device in which the reflection plate 11 is provided instead of the reflection plate 6. Also, FIG. 9 is an external isometric view of the reflection plate 11 only.

The reflection plate 11 projects towards the fan 2, and has a quadrangular pyramid shape with a vertex 11*a*. The vertex 11*a* is disposed substantially on or precisely on the rotation axis 2*a* preferably in the center of reflection plate 11, and is preferably the shortest distance between the fan 2 and the reflection plate 11. A sloping portion 11*b* is formed from the vertex 11*a* to the sides of the reflection plate 11. A depression portion 11*b* is formed in the outside of the reflection plate 11 corresponding to the quadrangular pyramid shaped projection.

In the case of the reflection plate 11 configured as described above, as an example, the reflection plate 11 can be disposed so that the distance from the fan 2 to the vertex 11*a* is the distance L.

Figure 10:
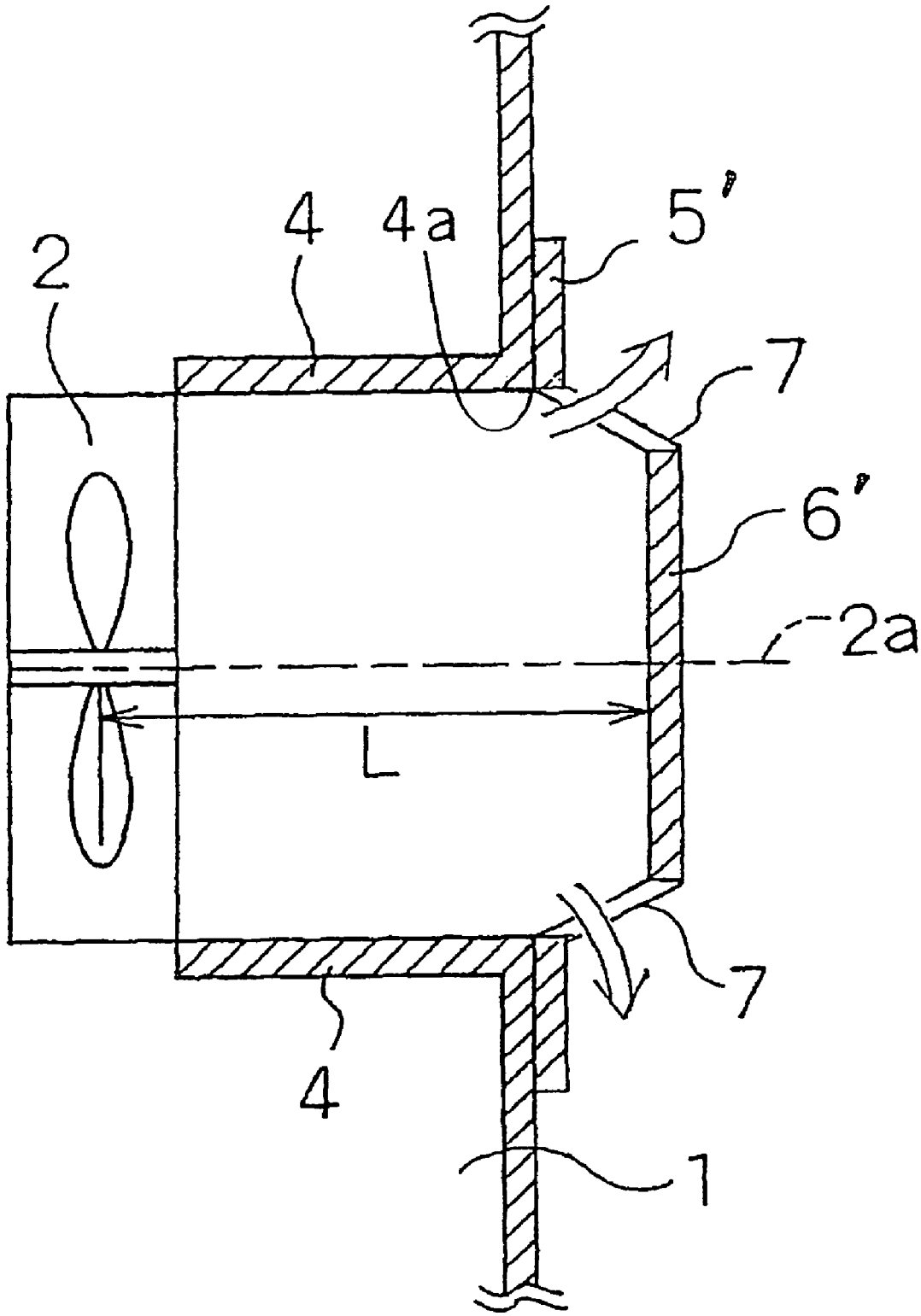
FIG. 10 is a cross-sectional plan view from above a silencing device according to a fifth embodiment of the present invention.

Also, in the present embodiment a reflection plate 6 whose area is almost equal or equal to the area of the aperture 4*a* of the duct 4 is provided on the cover 5. However, as shown in the cross-sectional plan view from above in FIG. 10, a reflection plate 6' in accordance with a fifth preferred embodiment of the present invention whose area is smaller than the area of the aperture 4*a* of the duct 4 may be provided in the cover 5. In this case, to reflect the sound from the fan 2 with as little leakage to the outside as possible, it is desirable that the length of the short side of the rectangular shaped reflection plate 6' be longer than the radius of the fan 2. It is more desirable that the length of the rectangular shaped reflection plate 6' be longer than the diameter of the fan 2.

Also, the reflection plates 6, 6', 10, 11, and 12 described above are all rectangular shaped, but they may also be circular shaped. In this case, it is desirable that the diameter of the reflection plate is larger than the diameter of the fan 2. This is in order to reflect the sound from the fan 2 while minimizing the leakage to the outside as much as possible.

When the reflection plate is circular shaped, the air discharge slits may be provided in a part of the periphery of the reflection plate.

Also, in the present embodiment, the sound whose frequency has the largest sound loudness level is reduced. However, the present invention may also be applied to the sound of specific frequencies that are perceived by people to be unpleasant.

Also, in the present embodiment, the cover 5 having the reflection plate 6 is fixed to the external wall 3 of the device 1. However, the distance from the fan 2 can be made adjustable to account for assembly tolerances and the like.

As an adjustable configuration, for example the cover 5 may be fixed by screws to the external wall 3, and packing may be provided between the sides of the cover 5 and the external wall 3. In this way the distance between the fan 2 and the reflection plate 6 can be finely adjusted by the number of layers of packing and the degree of tightening of the screws.

Also, the device 1 to which the silencing device according to the present invention can be applied includes copiers, printers, faxes, televisions, personal computers, and other devices provided with a fan to cool the interior of the device.

Next, an example of an embodiment of the silencing device according to the first embodiment is described.

Embodiment

The silencing device used in this example is the same as the device shown in FIG. 2.

Figure 11:
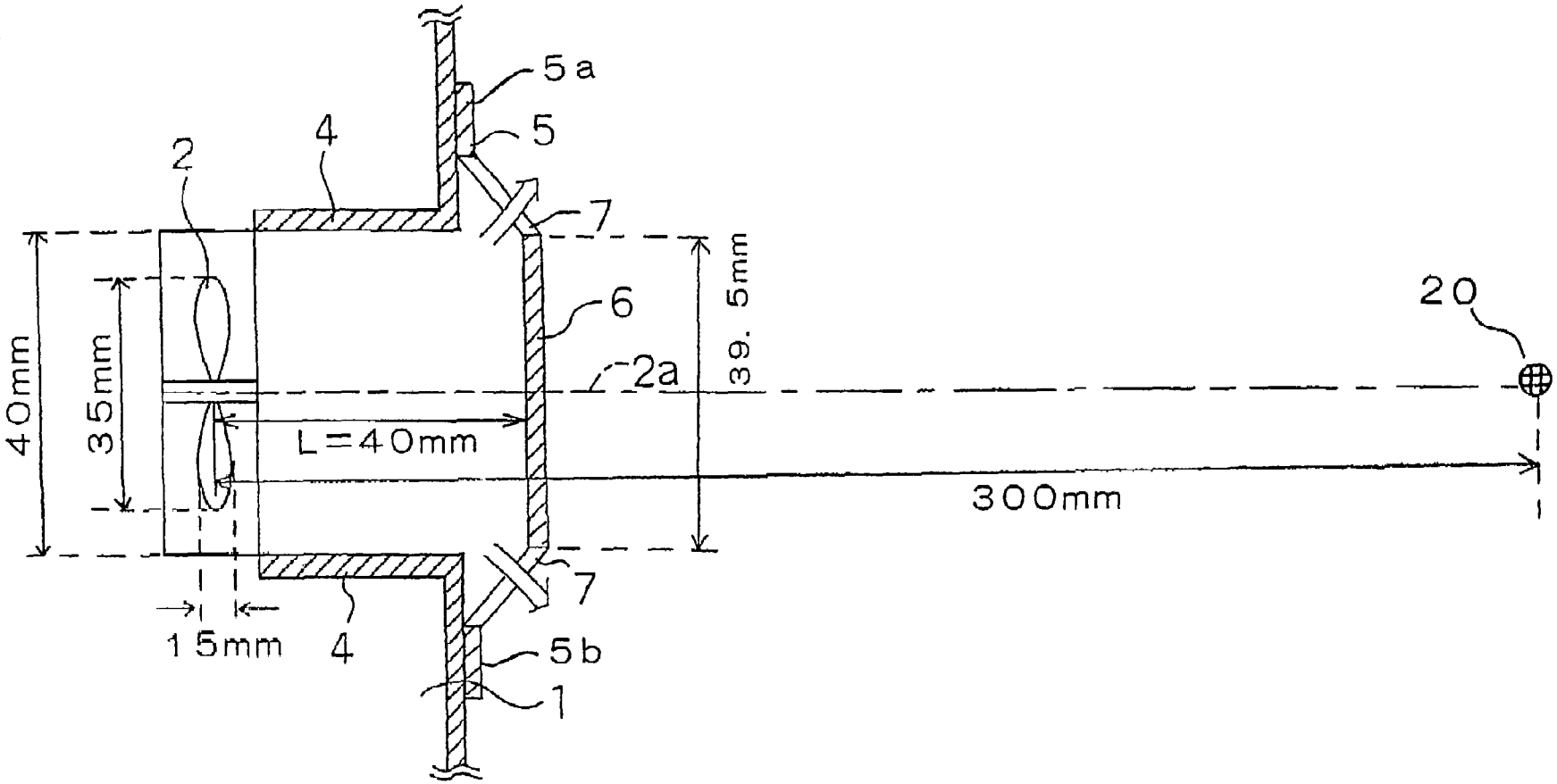
FIG. 11 is a cross-sectional plan view from above of the silencing device according to the first preferred embodiment of the present invention provided to illustrate relative dimensions.

Specifically, as shown in FIG. 11, the cross-section of the duct 4 according to the embodiment is square, with one side equal to 40 mm. The fan 2 used in the present embodiment has a diameter of 35 mm, five blades, and a thickness of 15 mm. Also, a square with side of about 39.5 mm was used as the reflection plate 6.

Also, the distance L from the center of the thickness of the fan 2 to the reflection plate 6 was 40 mm. Therefore, the blades were disposed between 32.5 mm and 47.5 mm from the reflection plate 6.

With this configuration a microphone 20 was provided in a position 300 mm from the fan 2 in the direction of the reflection plate 6 to collect and to analyze the sound generated by the fan 2. The distance 300 mm is the distance from the center of the fan 2 to the microphone 20.

Also, the rate of rotation of the fan 2 was 8000 rpm, and to analyze the sound a DS2000 FFT analyzer made by Ono Sokki Co., Ltd. was used.

Comparison Example

Apart from removal of the reflection plate 6, the sound generated by the fan 2 was analyzed under the same conditions as the embodiment described above.

Figure 12:
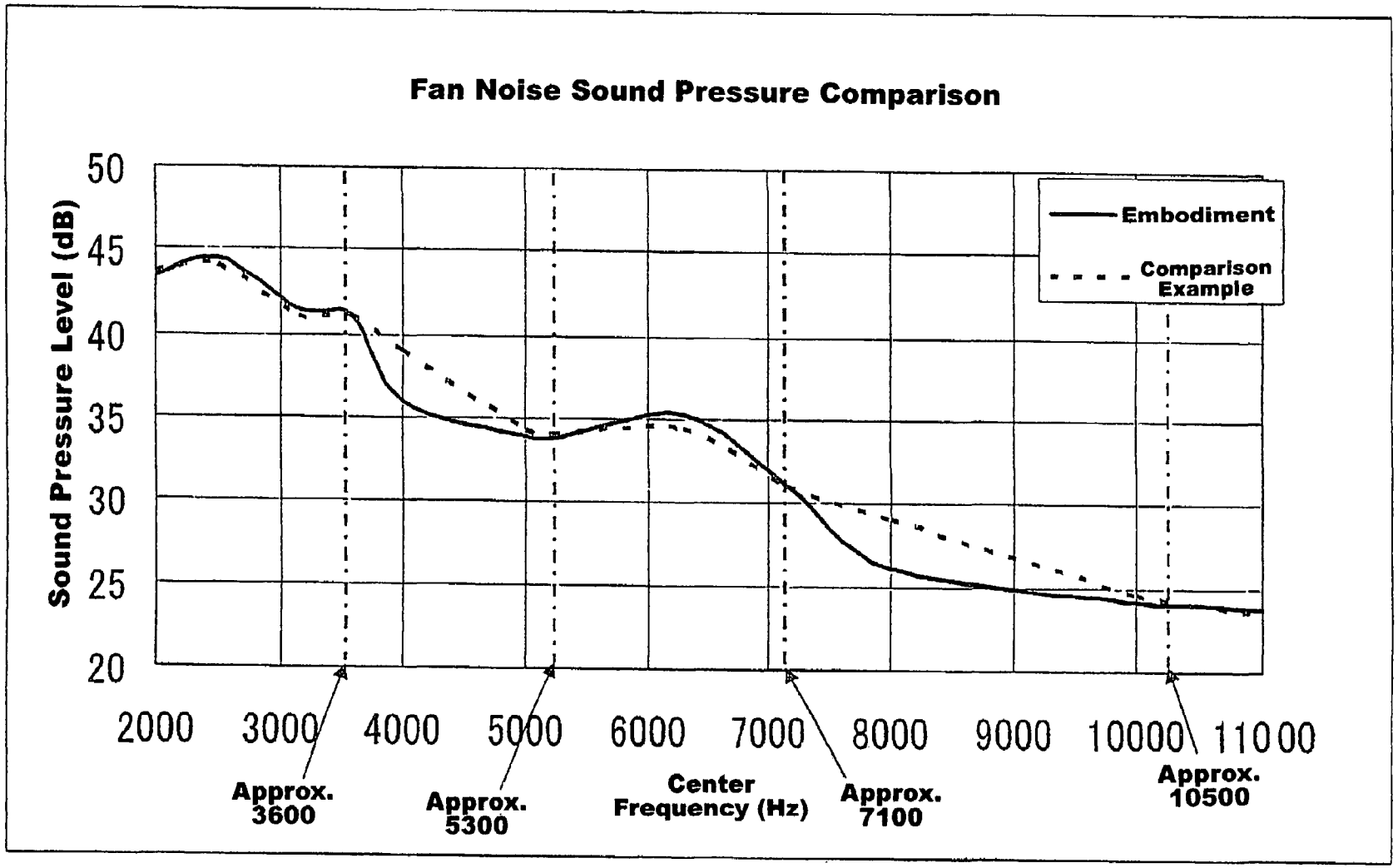
FIG. 12 is a view of a graph showing the sound pressure levels of the first embodiment of the present invention and a comparison example.
Figure 13:
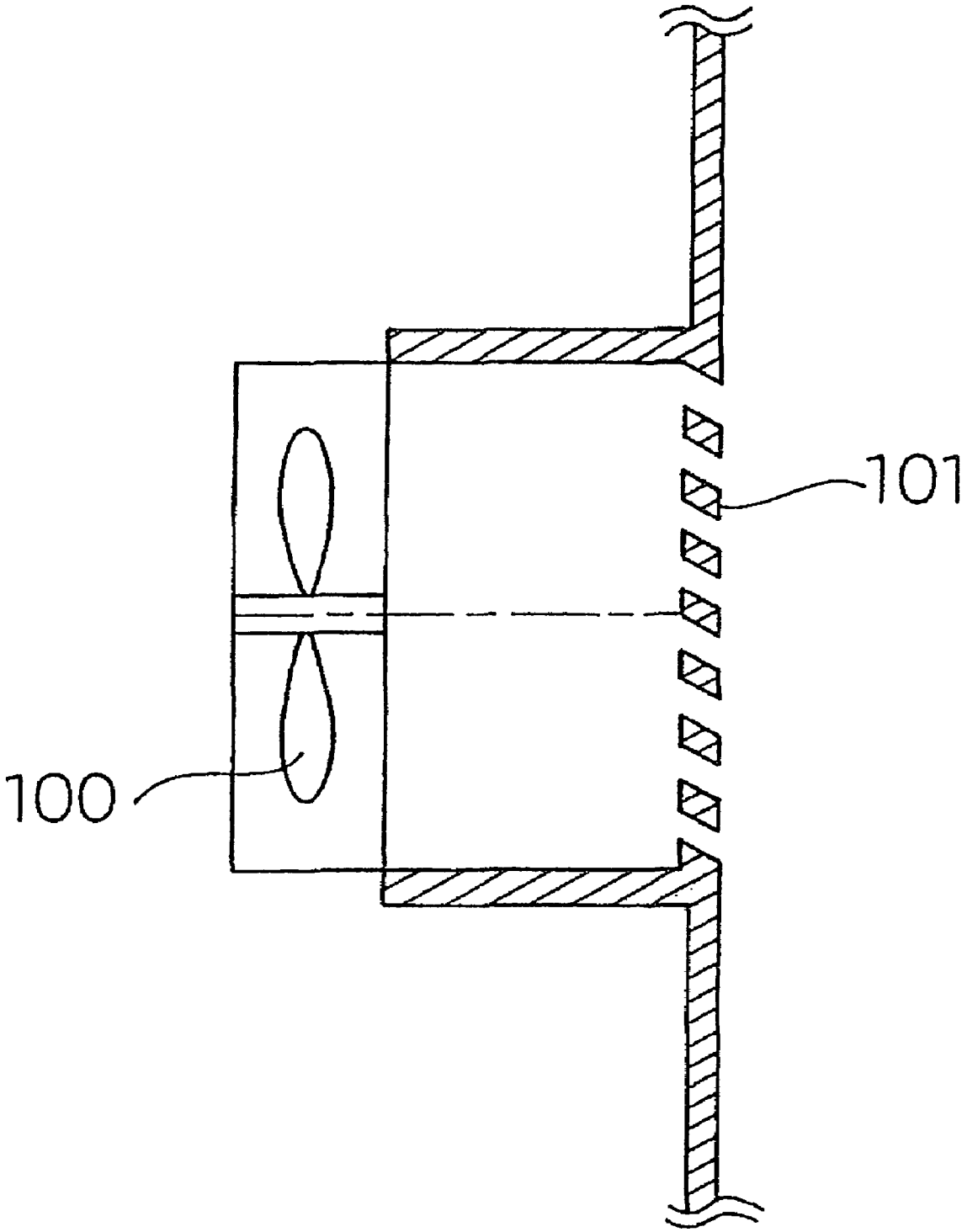
(Prior Art) Fig. 13
FIG. 13 is a cross-sectional view of a conventional fan cover.

The results of the analysis of the sound from the embodiment and the comparison example are shown in the graph in FIG. 12. In the graph of FIG. 12, the data for the embodiment are shown as a solid line, and the data for the comparison example are shown as a broken line.

Here, under the conditions of the embodiment and the comparison example, taking the thickness of the fan into consideration, the wind cutting sound was generated between 32.5 mm and 47.5 mm from the reflection plate 6.

In Equation (1) above, for n=1, the wavelength $\lambda$ is between 65.0 mm and 95.0 mm, and for a sound velocity of 340 m/s the frequency of the sound is between 3580 Hz and 5230 Hz. Also, for n=2, the wavelength $\lambda$ is between 32.5 mm and 47.5 mm, and the frequency of the sound is between 7160 Hz and 10460 Hz.

In other words, when the distance between the fan 2 and the reflection plate 6 is 40 mm and the thickness of the fan 2 is 15 mm, theoretically the sound pressure levels of the sound between 3580 Hz and 5230 Hz and between 7160 Hz and 10460 Hz are reduced in the embodiment to less than the levels in the comparison example.

Therefore, checking the graph of the test data in FIG. 12, it is seen that in the frequencies between 3580 Hz and 5230 Hz and between 7160 Hz and 10460 Hz the sound pressure levels are lower in the embodiment than in the comparison example.

From the above it can be seen that by adjusting the distance L from the fan 2 to the reflection plate 6 it is possible to reduce the sound of the desired frequencies.

INDUSTRIAL APPLICABILITY

The silencing device according to the present invention has the effect that noise can be reduced more easily and at lower cost, and is useful for devices having fans to cool the interior.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

In understanding the scope of the present invention, the term "configured" as used herein to describe a component, section or part of a device includes hardware and/or software that is constructed and/or programmed to carry out the desired function. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of a device equipped with the present invention. Accordingly, these terms, as utilized to describe the present invention should be interpreted relative to a device equipped with the present invention as used in the normal riding position. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An air discharge device comprising:

a fan having a rotation axis and being configured to rotate around the axis, the fan being configured to discharge air from the interior to the exterior; and a silencing device arranged in the path of air being discharged by the fan, the silencing device including a reflection plate provided on the rotation axis of the fan and being arranged substantially normal with respect to the rotation axis, the reflection plate having four edges and being configured to invert the phase of sound generated by the fan at specific frequencies, and a peripheral portion arranged to install the reflection plate on the silencing device, the reflection plate being disposed further out from the peripheral portion relative to the fan, and a peripheral sloping portion provided between the reflection plate and the peripheral portion, the sloping portion having a peripheral aperture positioned obliquely relative to the rotation axis.

2. The air discharge device according to claim 1, wherein the reflection plate is disposed at a position at a distance L from the center of the thickness of a fan, where $L=(\lambda/2)\times n$, n being a natural number, and $\lambda$ being the wavelength of the sound of the specific frequencies of the sound generated by the fan.

3. The air discharge device according to claim 1, further comprising a right-angled parallelepiped shaped duct that guides air from the fan to the outside of the silencing device via an aperture of the duct, wherein the fan is disposed at one end of the duct, the reflection plate and the aperture are disposed at the other end of the duct, and air discharge slits are formed in at least one edge of the four edges of the reflection plate.

4. The air discharge device according to claim 1, wherein the reflection plate is free of the slits.

5. The air discharge device according to claim 3, wherein the size of the reflection plate is substantially the same as the aperture of the duct.

6. The air discharge device according to claim 3, wherein the size of the reflection plate is smaller than the aperture of the duct.

7. The air discharge device according to claim 6, wherein the size of the reflection plate is larger than the diameter of the fan.

8. The air discharge device according to claim 1, wherein the reflection plate comprises a projecting portion projecting in the direction of the fan on the surface in opposition to the fan.

9. The air discharge device according to claim 8, wherein the projecting portion comprises a flat portion provided substantially in the center of the reflection plate, and a sloping portion formed from the flat portion to sides of the reflection plate.

10. The air discharge device according to claim 9, wherein the flat portion is rectangular.

11. The air discharge device according to claim 9, wherein the flat portion is circular.

12. The air discharge device according to claim 8, wherein the projecting portion comprises a vertex provided substantially in the center of the reflection plate and that is the shortest distance to the fan, and a sloping portion formed from the vertex to the sides of the reflection plate.

13. The air discharge device according to claim 1, wherein instead of having four edges, the reflection plate has a circular shape whose diameter is larger than the diameter of the fan.

14. The air discharge device according to claim 1, wherein the distance between the reflection plate and the fan is adjustable.

* * * * *